US008114169B2

(12) United States Patent
Rathi et al.

(10) Patent No.: US 8,114,169 B2
(45) Date of Patent: Feb. 14, 2012

(54) COMPOSITIONS FOR BIOBLEACHING COUPLED WITH STONE WASHING OF INDIGO DYED DENIMS AND PROCESS THEREOF

(75) Inventors: Chandrakant Laxminarayan Rathi, Maharashtra (IN); Saylee Sameer Pradhan, Maharashtra (IN)

(73) Assignee: Advanced Enzyme Technologies Limited, Maharashtra (IN)

( * ) Notice: Subject to any disclaimer, the term of this patent is extended or adjusted under 35 U.S.C. 154(b) by 109 days.

(21) Appl. No.: 12/438,665

(22) PCT Filed: May 8, 2007

(86) PCT No.: PCT/IN2007/000182

§ 371 (c)(1),
(2), (4) Date: Feb. 24, 2009

(87) PCT Pub. No.: WO2008/023386

PCT Pub. Date: Feb. 28, 2008

(65) Prior Publication Data

US 2010/0011510 A1 Jan. 21, 2010

(30) Foreign Application Priority Data

Aug. 25, 2006 (IN) ..... 1344/MUM/2006

(51) Int. Cl.
*D06L 3/11* (2006.01)

(52) U.S. Cl. ..... 8/102; 8/401; 8/101; 8/107; 8/111; 435/183

(58) Field of Classification Search ..... 435/183, 435/189; 510/375, 302; 8/401, 102
See application file for complete search history.

(56) References Cited

U.S. PATENT DOCUMENTS

| | | | | |
|---|---|---|---|---|
| 5,288,746 | A * | 2/1994 | Pramod | 510/321 |
| 5,480,643 | A * | 1/1996 | Donovan et al. | 424/409 |
| 5,908,472 | A | 6/1999 | Vollmond | |
| 6,015,707 | A | 1/2000 | Emalfarb et al. | |
| 6,146,428 | A * | 11/2000 | Kalum et al. | 8/401 |
| 2002/0016279 | A1 * | 2/2002 | Convents et al. | 510/392 |
| 2003/0040455 | A1 | 2/2003 | Shi et al. | |
| 2004/0038844 | A1 * | 2/2004 | Hage et al. | 510/375 |
| 2006/0063246 | A1 | 3/2006 | Paloheimo et al. | |

FOREIGN PATENT DOCUMENTS

| | | | |
|---|---|---|---|
| EP | 0 603 931 | A2 | 6/1994 |
| WO | 89/09813 | A1 | 10/1989 |
| WO | 98/07816 | A1 | 2/1998 |
| WO | 03/016615 | A1 | 2/2003 |
| WO | 2006/032724 | A2 | 3/2006 |

OTHER PUBLICATIONS

Pestell MSDS-Dextrose Monohydrate, issued on May 17, 2006 and accessed online.*
International Search Report: PCT/IN2007/000182.

* cited by examiner

*Primary Examiner* — Harold Pyon
*Assistant Examiner* — Katie L Hammer
(74) *Attorney, Agent, or Firm* — Ladas & Parry LLP

(57) ABSTRACT

Disclosed herein are novel compositions for biobleaching coupled with stone washing of indigo dyed denims comprising a blend of glucose oxidase, catalases and cellulases in the ratio of 1.0:10.0:1.0 along with sugar base, peroxide source and optional adjuvants and a process for the said biobleaching coupled with stone washing wherein the process is carried out at optimized conditions of neutral pH (6.5-7.0) and a temperature of 55° C. Processing time may vary from 15 minutes to 90 minutes depending on the extent of bleach required for the fabric.

6 Claims, No Drawings

COMPOSITIONS FOR BIOBLEACHING COUPLED WITH STONE WASHING OF INDIGO DYED DENIMS AND PROCESS THEREOF

TECHNICAL FIELD OF THE INVENTION

The present invention relates to novel compositions for biobleaching coupled with stone washing of indigo dyed denims comprising a blend of glucose oxidase, catalases and cellulases in the ratio of 1.0:10.0:1.0 along with sugar base, peroxide source and optional adjuvants. The present invention further relates to a process for the biobleaching coupled with stone washing wherein the process is carried out at optimized conditions of neutral pH (6.5-7.0) and a temperature of 55° C. Processing time may vary from 15 minutes to 90 minutes depending on the extent of bleach required for the fabric.

BACKGROUND AND PRIOR ART OF THE INVENTION

The domestic readymade garment sector is booming, and garment processing has emerged as one of the important production routes towards meeting quick changing demands of the fashion market. The spread of denim culture, all over the world brought with it a trend of fast changing fashions. One after another, several washes were introduced such as stone wash, acid wash, moon wash, monkey wash, show wash, frosted wash, white wash, mud wash, etc. Over the last 10 years, India has probably seen the most dramatic and exciting changes in the washing of denim garments.

The denim fabrics are processed for desizing, stonewashing, bleaching processes and can then be further processed for different colour depth. In case of ice wash more than half the dye is removed during washing. Use of lighter shade fabric will help to cut the process time, chemical consumption, effluent load and also will help the garment processor to process garment more economically and with minimum faults.

Desizing: Traditional desizing is performed by using acid or oxidative desizing agents which is associated with many drawbacks and limitations. The drawbacks associated with traditional desizing is that due to uncontrolled and nonspecific reaction, the cellulose material gets damaged and looses strength. Desizing consumes high energy and water. Desizing using acid treatment is expensive and has the hazards of environmental pollution. Environmental regulations have put intense pressure on the textiles industry to generate less pollution. Treating the wastewater and its disposal by neutralizing the acid increases the production costs for a pair of jeans.

Stonewashing/Biofading: In traditional washing process, volcanic rocks or pumice stones are added to the garments during washing as abradant. Due to ring dyeing and heavy abrasion, fading is more apparent but less uniform. The degree of colour fading depends on the garment to stone ratio, washing time, size of stones, material to liquor ratio and load of garments. Normally after desizing, stone wash process starts with pumice stone addition in rotary drum type garment washer. Process time varies from 60-120 mins. Stone wash effect is one of the oldest but highly demanded washing effects. Stone wash process gives "used" look or "vintage" on the garments, because of varying degree of abrasion in the area such as waistband, pocket, seam and body. There are many limitations and drawbacks associated with stone washing process. Some of the commonly observed drawbacks are that, the abrasion process is difficult to control, the desired look of the fabric (denim) is not achieved, possibility of damage being caused to the fabric and metal buttons and rivets on the denims, possibility of damage to the drum of the washing machine.

Bleaching: In this process, a strong oxidative bleaching agent such as sodium hypochlorite or KMnO4 (potassium permanganate) is added during the washing with or without stone addition. Discoloration is usually more apparent depending on the strength of the bleach liquor quantity, temperature and treatment time. Intensive research is underway for the development of sodium hypochlorite bleaching alternative eg, glucose bleaching, bleaching with sulphanic acid derivatives, and recently with laccase (enzyme). Laccase enzyme belongs to the oxidoreductase group. Laccase's oxidative effect is complex, it does not work independently. A mediator is necessary and a chemical mediator is employed between enzyme and indigo and the process using laccase enzyme has to be strictly followed at acidic ph (between 4.5-5) and temperature of 58 to 60° C.

U.S. Pat. No. 6,015,707 discloses novel compositions of neutral and/or alkaline cellulase and methods for obtaining neutral and/or alkaline cellulase compositions from *Chrysosporium* cultures, in particular *Chrysosporium lucknowense*. These neutral and/or alkaline cellulase compositions can be used in a variety of processes including stone washing of clothing, detergent processes, deinking and biobleaching of paper & pulp and treatment of waste streams.

U.S. Pat. No. 5,908,472 discloses a process for providing an abraded look with a reduced strength loss in dyed fabric comprising (a) contacting, in an aqueous medium, a dyed fabric with a cellulase in a concentration corresponding to 0.01-250 mu g of enzyme protein per g of fabric; and (b) simultaneously or subsequently treating the fabric with a phenol oxidizing enzyme and an enhancing agent.

WO2006032724 discloses novel laccase enzymes obtainable from the strains of the genus *Thielavia* or from the strains of the genus *Chaetomium*. The invention relates also to nucleic acid sequences encoding the enzymes, recombinant hosts into which the nucleic acid sequences have been introduced and to methods for the production of the enzymes in recombinant hosts. The enzymes of the invention are suitable for several applications, for example for treating denim and for strain removal.

WO03016615 discloses methods for enzymatic decolorization (bleaching) and dyeing, preferably overdyeing, of a textile material in a single bath process in which the decolorization and dyeing processes are performed in the same aqueous bath.

US2006063246 discloses a novel laccase enzyme obtainable from the strains of genus *Thielavia*. The invention relates also to the nucleic acid sequence encoding the enzyme, a recombinant host into which the nucleic acid sequence has been introduced and a method for the production of the enzyme in a recombinant host. The enzyme of the invention is suitable for several applications, in particular for increasing the lightness of denim.

US2003040455 discloses a process for removal of excess disperse dye from printed or dyed textile material, comprising treatment with a rinse liquor comprising at least one enzyme selected from the group consisting of enzymes exhibiting peroxidase activity or laccase activity, an oxidation agent, and at least one mediator.

WO9807816 discloses detergent compositions comprising a source of hydrogen peroxide, optionally a bleach activator and an antibody to control the hydrogen peroxide bleach deactivation due to the presence of donor:hydrogen peroxide oxido-reductase enzyme, especially catalase enzyme.

EP0603931 discloses compositions comprising 1-60% organic surfactant; 1-40% detergent builder; 0.1-20% glucose; 5-5000 U/g of compsn. of glucose oxidase; an H2O-soluble source of Cu(2+) and/or Ag(+) (to provide 0.1-100 ppm of Ag(+) and 20-200 ppm Cu(2+)); a catalyst capable of catalysing the bleaching effect of hydrogen peroxide; and at least 5% water.

Therefore, in view of the aforementioned drawbacks associated with prior art compositions for bleaching of fabrics, it is apparent that there exists a need for compositions which are effective and has customer friendly applications.

OBJECT OF THE INVENTION

The main object of the present invention is to provide novel compositions for biobleaching coupled with stone washing of indigo dyed denims comprising a blend of glucose oxidase, catalases and cellulases in the ratio of 1.0:10.0:1.0 along with sugar base, peroxide source and optional adjuvants.

Another object of the present invention is to provide a process for the biobleaching coupled with stone washing wherein the process is carried out at optimized conditions of neutral pH (6.5-7.0) and a temperature of 55° C.

Yet another object of the invention is to provide a new enzyme based washing technology which helps to conserve water, time, energy and environment and thereby offers a customer friendly application.

SUMMARY OF THE INVENTION

The present invention discloses novel compositions for biobleaching coupled with stone washing of indigo dyed denims comprising a blend of glucose oxidase, catalases and cellulases in the ratio of 1.0:10.0:1.0 along with sugar base, peroxide source and optional adjuvants. The present invention further discloses a process for the biobleaching coupled with stone washing wherein the process is carried out at optimized conditions of neutral pH (6.5-7.0) and a temperature of 55° C. Processing time may vary from 15 minutes to 90 minutes depending on the extent of bleach required for the fabric. The extent of bleaching can be compared with either sodium hypochlorite bleaching effect or laccase enzyme using mediator bleaching effect.

DESCRIPTION OF THE INVENTION

The present invention describes novel compositions for biobleaching coupled with stone washing of indigo dyed denims comprising a blend of glucose oxidase, catalases and cellulases in the ratio of 1.0:10.0:1.0 along with sugar base, peroxide source and optional adjuvants.

The present invention further describes a process for biobleaching coupled with stone washing wherein the process is carried out at optimized conditions of neutral pH (6.5-7.0) and a temperature of 55° C. Processing time may vary from 15 minutes to 90 minutes depending on the extent of bleach required for the fabric.

As per the present invention the denims which are stonewashed by the addition of an effective amount of oxidoreducatse enzyme during cellulase treatment shows a reduction in the level of backstaining, especially the backstaining of pocket parts as well as a bleached effect is seen on the overall denim fabric. An effective amount of enzyme used for the stone washing coupled with biobleaching is 1.5 gm of the bioenhancer blend per litre of the water wherein the enzymes glucose oxidase, catalase and cellulase are present in the ratio of 1.0:10.0:1.0.

The extent of bleaching can be compared with either sodium hypochlorite bleaching effect or laccase enzyme using mediator bleaching effect. Laccase enzyme belongs to the oxidoreductase group. Laccase's oxidative effect is complex, it does not work independently. A mediator is necessary and a chemical mediator is employed between enzyme and indigo and the process using laccase enzyme has to be strictly followed at acidic ph (between 4.5-5) and temperature of 58 to 60° C.

The process of biobleaching coupled with stone washing as per the present invention comprises contacting the denim to be enzymatically biobleached with a composition comprising a blend of cellulases and oxidoreductases enzyme in absence of chemical mediator in an amount sufficient to reduce backstaining and give bleached effect. Oxidoreductase enzyme is comprised of glucose oxidase and catalase enzymes in the ratio of 1.0:10.0.

Oxidoreductase enzyme: Oxidoreductase is an enzyme that catalyzes the transfer of electrons from one molecule (the oxidant, also called the hydrogen donor or electron donor) to another (the reductant, also called the hydrogen acceptor or electron acceptor). An enzyme that catalyses this reaction would be an oxidoreductase.

One glucose oxidase unit causes the oxidation of one micromole of o-dianisidine per minute at 25° C. and pH 6.0 under the conditions specified. The glucose oxidase activity can be determined using glucose as substrate.

Catalase enzyme: Catalase (human erythrocyte catalase) is a common enzyme found in living organisms. Functions of catalase include catalyzing the decomposition of hydrogen peroxide to water and oxygen. Catalase has one of the highest turnover rates for all enzymes; one molecule of catalase can convert 5 million molecules of hydrogen peroxide to water and oxygen each minute. Catalase is a tetramer of 4 polypeptide chains having at least 500 amino acids in length. Within this tetramer there are 4 porphyrin haem (iron) groups which are what allows it to react with the hydrogen peroxide. Its optimum pH is at a neutral level.

One catalase unit decomposes one micromole of $H_2O_2$ per minute at 25° C. and pH 7.0 under the specified conditions. Catalase activity can be determined using hydrogen peroxide as substrate.

Cellulase enzyme: Three general types of enzymes make up the cellulase enzyme complex. Endocellulase breaks internal bonds to disrupt the crystalline structure of cellulose and expose individual cellulase polysaccharide chains. Exocellulase cleaves 2-4 units from the ends of the exposed chains produced by endocellulase, resulting in the tetrasaccharides or disaccharide such as cellobiose. Cellobiase or beta-glucosidase hydrolyses the endocellulase product into individual monosaccharides.

One cellulase unit of activity releases 0.01 mg glucose per hour from micro-crystalline cellulose at 37° C. and pH 5.0 under the specified conditions. Cellulase activity can be determined using microcrystalline cellulose as substrate.

The amount of oxidoreductase enzyme used for the biobleaching process depends upon the amount of cellulase enzyme used in the combined stonewashing and bleaching process, the contact time, the amount of dye to be removed during the combined process, the activity of the cellulase, catalase and glucose oxidase, the pH and temperature of the combined process, the formulation of the product and the like. The contact time may vary from 15 minutes to 90 minutes depending upon the desired bleaching effect required. For slight bleaching effect the time of 15 minutes can be chosen and for getting the extreme effect 90 minutes can be chosen.

In a preferred embodiment as per the present invention, the novel compositions may further comprise various adjuvants like surfactants, fillers, buffers, pH control agents, enzyme activators, builders, enzyme stabilizers, anti-deposition agent, sugar base, Protease and the like. Surfactants used for the bioenhancer compositions are selected from the group consisting of Polyvinyl pyrrolidone, polyacrylate and polyacrylamide and are used in the range of 8% to 15%. Fillers are selected from the group consisting of sodium salt of sulphate, phosphate, mono phosphate, di phosphate and are used in, the range of 40% to 60%. Buffers are selected from the group consisting of sodium salts of citrates, monophosphates, diphosphates, triphosphates and are used in the range of 30% to 40%. pH control agents are selected from the group consisting of citric acid, adipic acid, monosodium phosphate and are used in the range of 10% to 30%. Enzyme activators are selected from the group consisting of calcium salts of chlorides, magnesium salts of chlorides, sulphates and are used in the range of 5% to 20%. Builders are selected from the group consisting of wood flour, saw dust, dry protein powder, soay powder and are used in the range of 60% to 90%. Enzyme stabilisers are selected from the group consisting of propylene glycol 4000, polyethylene glycol 6000 and are used in the range of 5% to 15%. Antideposition agents are selected from the group consisting of polyvinyl pyrrolidone like polyvinyl pyrrolidone K 30 and are used in the range of 1% to 5%. Sugar base can be used in the range of 30% to 50%. The sugar base as per the invention is glucose (Dextrose monosaccharide) and is used as a substrate of glucose oxidase to have the action. Peroxides can be used in the range of 20% to 40% in the composition. The composition as per the present invention may be formulated as a solid product in the form of free flowing powder and can be made available as bulk supply.

As per another preferred embodiment, the process of biobleaching and stone washing as per the present invention is applicable to fabrics in general. The fabrics include fabrics/textiles prepared from man-made fibers, e.g. cellulosic fabrics or textiles. The process as per the invention is preferably applicable to cellulose-containing fabrics, such as cotton, viscose, rayon, ramie, linen or mixtures thereof, or mixtures of any of these fibers with synthetic fibers. More particularly the fabric that is processed as per the present invention is denim.

As per yet another embodiment of the present invention, the enzymes used are cellulases, catalases and glucose oxidase. The glucose oxidase enzymes and catalase enzymes used are preferably of microbial origin, in particular of fungal origin. The oxidoreductase and cellulase enzymes used are derived from a strain of *Aspergillus niger, Phanerochaete chrysosporium, coriplus vesicular*, a strain of *Fusarium*, in particular *Fusarium oxysporum, Fusarium solani*, strain of *Humicola*, in particular *Humicola brevispora, Humicula lanuginosa, Humicola brevis* var. *thermoidea*, and *Humicola insolens*. More particularly, Glucose oxidase has been obtained from *Aspergillus niger*, Catalase from *Aspergillus niger* and Cellulase as variant from *Humicola Insolens*.

The novel compositions and process of biobleaching coupled with stonewashing as per the present invention provides a new enzyme based washing technology which helps to conserve water, time, energy and environment and thereby offers a customer friendly application.

Size is the substance or mixture of substances that is applied to the warp thread before weaving. The size forms a coating around the surface of the thread before weaving. This coating provides the lubrication & prevents the breakage of warp thread during the weaving operation. Chemicals which are often used to prepare the sizes include starch, polyacrylic acid, polyvinyl alcohol, carboxymethyl cellulose and paraffin waxes. Starch has good sizing properties and therefore is often used for sizing of cellulosic fibres.

Moreover starch is economical as compared to other chemicals. Due to the sizing, the fabrics do not absorb water or any other finishing agents required for finishing of the fabric. It is therefore necessary to remove the size before proceeding for any further processing of the fabric.

Desizing of the Fabric:

Desizing is the process by which the sizes of the fabrics are removed. Starch is made soluble by hydrolysis reaction in which the starch polymer is broken down into small soluble fragments. As per the present invention, the desizing of the fabric (denim) is done by enzymatic desizing process using amylase enzyme. Amylase enzyme can be added in an amount of 1.0 gm/litre of the bath. Amylase enzyme is responsible for the catalyses of hydrolysis of starch. Amylase enzyme helps in complete removal of starch containing size. Since amylase enzyme does not affect the cellulose there is no damage caused to the cellulosic fabric. Enzymes are destroyed when subjected to high temperature conditions. So a safe temperature range is required in order for the enzyme to posses its activity. Amylases are used for this process since they do not harm the textile fibres. Desizing process is done by bringing the fabric in contact with the amylase enzyme wherein the enzyme is absorbed by the fabric and the size is broken down. The broken size is removed by performing a hot wash.

Stone washing as per the present invention is done using cellulase enzyme. For stone washing the cellulase enzyme is added in an amount of 1.0 gm of enzyme/litre of the bath and the washing time can be set for 60 mins with temperature of 55° C. Denims are made from cotton, a cellulosic material. Cellulase enzymes are capable of breaking down the surface cellulose fibres of the denims in a controlled manner without seriously damaging the fabric. Cellulase enzyme provides the desired worn look for the fabric.

Process of Biobleaching:

The process of biobleaching employed for denim textiles (especially indigo-dyed denims) as per the present invention is carried out after desizing and performing one plain water wash. After the desizing process, the fabric is generally processed for biofading or stonewashing. The bioenhancer blend comprising a blend of glucose oxidase, catalases and cellulases in the ratio 1.0:10.0:1.0 is added after stonewashing with cellulase enzyme to obtain a bleaching effect so as to obtain a desired worn look for the denims.

Processing Conditions:

The process as per the present invention is carried out at conventional conditions in a washing machine conventionally used for stone-washing, e.g. a washer-extractor. The enzyme of the invention should be added in specific amount. By the term specific amount is meant the amount sufficient to reduce backstaining as well as to give a bleaching effect. 1.5 gm of the enzyme in 1000 ml of the water is found to be effective. Typical conditions are a temperature of 40°-60° C. and a pH of 4.5-7.5. However, the processing conditions must be chosen according to the characteristics of the enzyme which is been used. Optionally additives may be used, e.g. a buffer, a surfactant (mild anionic and/or non-ionic) and/or a polymer (such as PVP, polyacrylate and polyacrylamide). Optimum conditions are at neutral pH (6.5-7.0), temperature (55° C.) and the time of processing can be varied from 15 minutes to 90 minutes depending on the extent of desired final look of the fabric.

Color Measurement:

A Hunterlab spectrophotometer Hunter associates laboratory inc, Reston was used according to the manufacturer's instructions to evaluate the chromaticity using the change in the color space coordinates L*a*b* and L*a*b*WI* (CIELAB-system), where, L* denotes the change in white/black on a scale from 0 to 100, and a decrease in L* means an increase in black color (decrease in white color) and an increase in L* means an increase in white color (decrease in black color).

a* denotes the change in red/green, and a decrease in a* means an increase in green color (decrease in red color), and an increase in a* means an increase in red color (decrease in green color).

b* denotes the change in blue/yellow, and a decrease in b* means an increase in blue color (decrease in yellow color), and an increase in b* means an increase in yellow color (decrease in blue color).

WI* denotes Whiteness Index which is associated with a region or volume in color space in which objects are recognized as white. Degree of whiteness is measured by the departure of the object from a perfect white.

Effect of bioenhancer blend on indigo dyed fabric: Different formulations are listed below through various examples and the denim swatches were developed in such a way that before desizing and after desizing trials were conducted and their L*a*b* values were compared.

The present investigation is more specifically explained by following examples. However, it should be understood that the scope of the present invention is not limited by the examples in any manner. It will be appreciated by any person skilled in this art that the present investigation includes the following examples and further can be modified and altered within the technical concept of the present investigation.

EXAMPLES

Example 1

| Ingredients | Quantity |
|---|---|
| Blend of Glucose oxidase and Catalase | 1% to 5% |
| Sugar base | 30% to 50% |
| Cellulase | 0.25% to 1.5% |
| Surfactant | 8% to 15% |
| Filler | 10% to 30% |
| Peroxide | 20% to 40% |

[Denim Swatch was first desized and then biobleached using bioenhancer blend].

Washing Conditions:—

| | |
|---|---|
| Temperature | 55 degree C. |
| Washing Time | 30, 45, 60 min |
| Enzyme | Bioenhancer blend |
| Enzyme dosage | 1.5 gm of enzyme/Liter of bath |
| Washing liquor | Deionized water |
| Bath ratio | 1:20 (1 kg of Garment:20 liter of water) |
| Washing machine | Ronald washing machine |
| Swatches | (50 cm · times · 20 cm) of blue dyed indigo cotton |

Hunter Lab Reading:

| Time | L* | A* | B* | WI* |
|---|---|---|---|---|
| 30 | 19.63 | −0.39 | −11.26 | 17.42 |
| 45 | 21.43 | −1.00 | −12.45 | 20.76 |
| 60 | 23.29 | −1.46 | −12.48 | 23.59 |

Example 2

| Ingredients | Quantity |
|---|---|
| Blend of Glucose oxidase and Catalase | 1% to 5% |
| Sugar base | 30% to 50% |
| Cellulase | 0.25% to 1.5% |
| Surfactant | 8% to 15% |
| Filler | 10% to 30% |
| Peroxide | 20% to 40% |

[Denim Swatch was first desized and stone washed and then biobleached using bioenhancer blend].

Washing Conditions:—

| | |
|---|---|
| Temperature | 55 degree C. |
| Washing Time | 30, 45, 60 min |
| Enzyme | Bioenhancer blend |
| Enzyme dosage | 1.5 g of enzyme/Liter of bath |
| Washing liquor | Deionized water |
| Bath ratio | 1:20 (1 kg of Garment:20 liter of water) |
| Washing machine | Ronald washing machine |
| Swatches | (50 cm · times · 20 cm) of blue dyed indigo cotton |

Hunter Lab Reading:

| Time | L* | A* | B* | WI* |
|---|---|---|---|---|
| 30 | 27.04 | −2.45 | −9.94 | 25.55 |
| 45 | 28.45 | −2.18 | −10.89 | 27.24 |
| 60 | 31.01 | −2.54 | −10.49 | 29.64 |

Example 3

| Ingredients | Quantity |
|---|---|
| Blend of Glucose oxidase and Catalase | 1% to 5% |
| Sugar base | 30% to 50% |
| Cellulase | 0.25% to 1.5% |
| Surfactant | 8% to 15% |
| Protease base | 10 to 50 u |
| Filler | 10% to 30% |
| Peroxide | 20% to 40% |

[Denim Swatch was first desized and then biobleached using bioenhancer blend].

Washing Conditions:—

| | |
|---|---|
| Temperature | 55 degree C. |
| Washing Time | 30, 45, 60 min |
| Enzyme | Bioenhancer blend |
| Enzyme dosage | 1.5 gm of enzyme/Liter of bath |
| Washing liquor | Deionized water |
| Bath ratio | 1:20 (1 kg of Garment:20 liter of water) |
| Washing machine | Ronald washing machine |
| Swatches | (50 cm · times · 20 cm) of blue dyed indigo cotton |

Hunter Lab Reading:

| Time | L* | A* | B* | WI* |
|---|---|---|---|---|
| 30 | 20.26 | −0.42 | −11.87 | 18.81 |
| 45 | 22.23 | −0.97 | −12.66 | 22.83 |
| 60 | 23.89 | −1.41 | −13.07 | 25.19 |

Example 4

| Ingredients | Quantity |
|---|---|
| Blend of Glucose oxidase and Catalase | 1% to 5% |
| Sugar base | 30 to 50% |
| Cellulase | 0.25% to 1.5% |
| Surfactant | 8% to 15% |
| Protease base | 10 to 50 u |
| Filler | 10% to 30% |
| Peroxide | 20% to 40% |

[Denim Swatch was first desized and stone washed and then biobleached using bioenhancer blend].

Washing Conditions:—

| | |
|---|---|
| Temperature | 55 degree C. |
| Washing Time | 30, 45, 60 min |
| Enzyme | Bioenhancer blend |
| Enzyme dosage | 1.5 gm of enzyme/Liter of bath |
| Washing liquor | Deionized water |
| Bath ratio | 1:20 (1 kg of Garment:20 liter of water) |
| Washing machine | Ronald washing machine |
| Swatches | (50 cm · times · 20 cm) of blue dyed indigo cotton |

Hunter Lab Reading:

| Time | L* | A* | B* | WI* |
|---|---|---|---|---|
| 30 | 25.57 | −1.99 | −10.46 | 24.76 |
| 45 | 28.45 | −1.99 | −11.03 | 28.61 |
| 60 | 31.85 | −2.37 | −10.24 | 29.76 |

Example 5

| Ingredients | Quantity |
|---|---|
| Blend of Glucose oxidase and Catalase | 1% to 5% |

-continued

| Ingredients | Quantity |
|---|---|
| Sugar base | 5% to 20% |
| Cellulase | 0.25% to 1.5% |
| Surfactant | 8% to 15% |
| Filler | 10% to 30% |
| Peroxide | 20% to 40% (after fading) |

[Denim Swatch was first desized and stone washed and then biobleached using bioenhancer blend].

Washing Conditions:—

| | |
|---|---|
| Temperature | 55 degree C. |
| Washing Time | 15 30 45 min |
| Enzyme | Bioenhancer blend |
| Enzyme dosage | 1.5 gm of enzyme/Liter of bath |
| Washing liquor | Deionized water |
| Bath ratio | 1:20 (1 kg of Garment:20 liter of water) |
| Washing machine | Ronald washing machine |
| Swatches | (50 cm · times · 20 cm) of blue dyed indigo cotton |

Hunter Lab Reading:

| Time | L* | A* | B* | WI* |
|---|---|---|---|---|
| 30 | 28.16 | −2.03 | −9.62 | 25.02 |
| 45 | 29.66 | −2.72 | −9.45 | 26.91 |
| 15 | 25.10 | −1.65 | −10.02 | 20.57 |

Example 6

| Ingredients | Quantity |
|---|---|
| Blend of Glucose oxidase and Catalase | 1% to 5% |
| Sugar base | 30 to 50% |
| Cellulase | 0.25% to 1.5% |
| Surfactant | 8% to 15% |
| Filler | 10% to 30% |

[Denim Swatch was first desized and then biobleached using bioenhancer blend].

Washing Conditions:—

| | |
|---|---|
| Temperature | 55 degree C. |
| Washing Time | 60 90 min |
| Enzyme | Bioenhancer blend |
| Enzyme dosage | 1.5 gm of enzyme/Liter of bath |
| Washing liquor | Deionized water |
| Bath ratio | 1:20 (1 kg of Garment:20 liter of water) |
| Washing machine | Ronald washing machine |
| Swatches | (50 cm · times · 20 cm) of blue dyed indigo cotton |

Hunter Lab Reading:

| Time | L* | A* | B* | WI* |
|---|---|---|---|---|
| 60 | 22.59 | −0.86 | −11.55 | 22.52 |
| 90 | 24.35 | −1.08 | −11.48 | 23.17 |

Example 7

| Ingredients | Quantity |
|---|---|
| Blend of Glucose oxidase and Catalase | 1% to 5% |
| Sugar base: | 10% to 40% |
| Cellulase | 0.25% to 1.5% |
| Surfactant | 8% to 15% |
| Filler | 10% to 30% |
| Peroxide | 20% to 40% |

[Denim Swatch was first desized and then biobleached using bioenhancer blend].

Washing Conditions:—

| | |
|---|---|
| Temperature | 55 degree C. |
| Washing Time | 45 60 90 min |
| Enzyme | Bioenhancer blend |
| Enzyme dosage | 1.5 gm of enzyme/Liter of bath |
| Washing liquor | Deionized water |
| Bath ratio | 1:20 (1 kg of Garment:20 liter of water) |
| Washing machine | Ronald washing machine |
| Swatches | (50 cm · times · 20 cm) of blue dyed indigo cotton |

Hunter Lab Reading:

| Time | L* | A* | B* | WI* |
|---|---|---|---|---|
| 45 | 18.55 | −0.14 | −10.96 | 15.52 |
| 60 | 20.92 | −0.71 | −12.24 | 20.37 |
| 90 | 25.25 | −1.93 | −12.00 | 24.54 |

Example 8

| Ingredients | Quantity |
|---|---|
| Blend of Glucose oxidase and Catalase | 1% to 5% |
| Sugar base | 5% to 20% |
| Cellulase | 0.25% to 1.5% |
| Surfactant | 8% to 15% |
| Filler | 10% to 30% |
| Peroxide | 20% to 40% |

[Denim Swatch was first desized and stone washed and then biobleached using bioenhancer blend].

Washing Conditions:—

| | |
|---|---|
| Temperature | 55 degree C. |
| Washing Time | 15 30 45 60 min |
| Enzyme | Bioenhancer blend |
| Enzyme dosage | 1.5 gm of enzyme/Liter of bath |
| Washing liquor | Deionized water |
| Bath ratio | 1:20 (1 kg of Garment:20 liter of water) |
| Washing machine | Ronald washing machine |
| Swatches | (50 cm · times · 20 cm) of blue dyed indigo cotton |

Hunter Lab Reading:

| Time | L* | A* | B* | WI* |
|---|---|---|---|---|
| 15 | 24.54 | −1.90 | −10.02 | 21.80 |
| 30 | 25.45 | −1.58 | −10.53 | 22.10 |
| 45 | 26.12 | −1.70 | −10.41 | 23.75 |
| 60 | 27.29 | −1.90 | −10.44 | 25.19 |

Fabrics in the Example No. 1, 3, 6 and 7 were desized and then treated with bioenhancer while in the Example No. 2, 4, 5 and 8 the fabrics were desized, stone washed and them treated with bioenhancer blend. The difference observed by following the two different methods are evident from the Humter Lab readings of L*a*b*WI*. The WI* reading is observed more when the fabric is desized, stone washed (fading) and then treated with bioenhancer blend.

Example 9

Process of biobleaching as per the present invention can be described in a sequential manner as follows:

i. Fill the Ronald washing machine with 20 litres of water.

ii. Adjust the temp to 55° C. and pH to 6-7.

iii. Load the garments (1 kg of garments to 20 litres of water)

iv. Desizing is done using amylase enzyme.

v. Drain.

vi. Hot water wash is performed.

vii. Fill the machine with water (20 lit)

viii. Add cellulase enzyme for stonewashing ix. Drain x. Hotwash is performed.

xi. Fill the machine with water (20 lit).

xii. Bioenhancer blend added and run for 15, 30, 45 minutes.

xiii. Drain.

xiv. Hotwash is performed.

Mechanism of action of enzymes involved in the biobleaching processes are as follows, The effect of biobleaching as per the present invention is due to result of alternating cycles of desizing and stonewashing and bleaching enzymes in the washing machines.

Glucose oxidase (β-D-glucose:oxygen 1-oxidoreductase, EC1.1.3.4) catalyses the oxidation of β-D-glucose to D-glucono-1,5-lactone and hydrogen peroxide, using molecular oxygen as the electron acceptor.

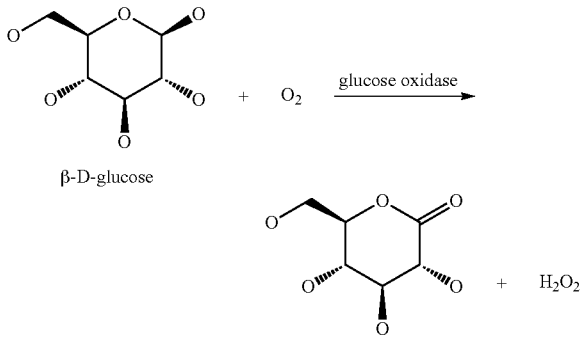

Catalase catalyzes the decomposition of hydrogen peroxide to water and oxygen. The reaction of catalase in the decomposition of hydrogen peroxide is as follows, $$2H_2O_2 \rightarrow 2H_2O + O_2$$

When oxygen reacts with indigo dye of the denims, oxygen is added to the double bond at the middle of the indigo molecule causing that one indigo to become two benzene derivatives and the colour disappears.

Cellulase is an enzyme complex which breaks down cellulose to beta-glucose.

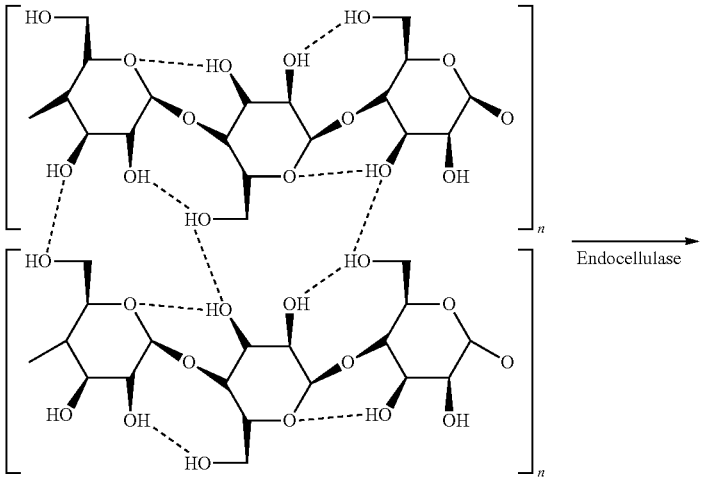

Cellulose (crystal)

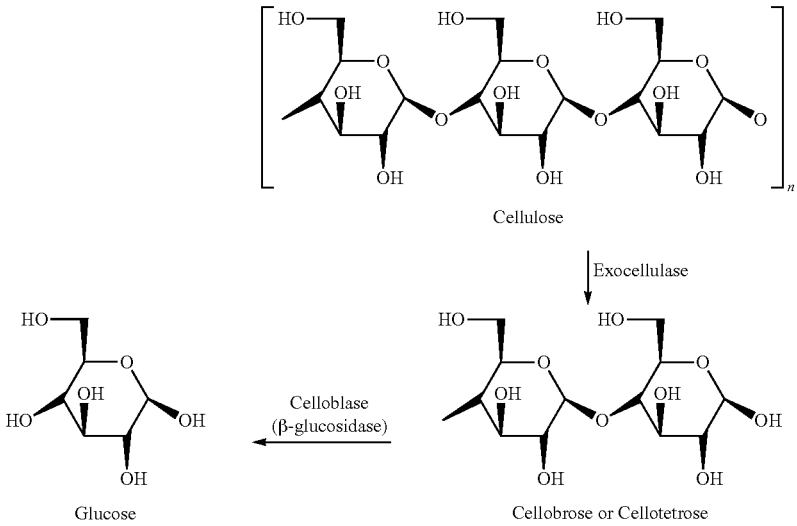

The advantages of biobleaching coupled with stone washing as per the present invention are as follows, 1) The fabrics are not damaged as there is no abrasion involved in the process of bleaching and the desired worn look for the fabric is achieved.
2) A small quantity of the enzyme is required as compared to pumice stones which are required in large numbers.
3) The process consumes less time as compared to other processes which consumes more time for washing the fabric several times so as to get rid of the stone fragments from the fabric.
4) Water and energy can be conserved since many washes are not required for the fabric.
5) The process does not cause any pollution and therefore is environmentally friendly and economic. The tedious procedures involved in effluent treatment of waste water are not required, so thereby being economic.
6) The process of biobleaching coupled with stone washing is free of health hazards normally associated with conventional stone washing using stones/pumice.

Assay of the enzymes are as described below:

1) Assay of Catalase

Method: One unit decomposes one micromole of $H_2O_2$ per minute at 25° C. and pH 7.0 under the specified conditions.

Reagents: 0.05 M Potassium phosphate, pH 7.0, 0.059 M Hydrogen peroxide (Merck's Superoxol or equivalent grade) in 0.05 M potassium phosphate, pH 7.0

Enzyme: Immediately prior to use dilute the enzyme in 0.05 M phosphate buffer, pH 7.0 to obtain a rate of 0.03-0.07 ΔA/min.

$$\text{mg protein/ml} = A280 \times 0.667^{*}$$

* This factor is not appropriate when thymol is present (Catalase CTR)

Procedure

Adjust the spectrophotometer to 240 nm and 25° C.

Pipette into each cuvette as follows:

| Reagent | Quantity |
|---|---|
| Reagent grade water | 1.9 ml |
| 0.059M Hydrogen peroxide | 1.0 ml |

Incubate in spectrophotometer for 4-5 minutes to achieve temperature equilibration and to establish blank rate if any. Add 0.1 ml of diluted enzyme and record decrease in absorbance at 240 nm for 2-3 minutes. Calculate $\Delta A_{240}$/min from the initial (45 second) linear portion of the curve.

Calculation $$\text{Units/mg} = \frac{\Delta A240/\text{min} \times 100}{43.6 \times \text{mg enzyme/ml reaction mixture}}$$

2) Assay of Glucose Oxidase

Method: One unit causes the oxidation of one micromole of o-dianisidine per minute at 25° C. and pH 6.0 under the conditions specified.

Reagents: 0.1 M Potassium phosphate buffer, pH 6.0, 1% o-Dianisidine:

(Note: o-dianisidine has been reported to be carcinogenic in the solid form. Handle with care.)

Peroxidase: Dissolve peroxidase at a concentration of 200 micrograms per ml in reagent grade water.

18% Glucose: Allow mutarotation to come to equilibrium by standing overnight at room temperature.

Dianisidine-buffer mixture: Prepare by diluting 0.1 ml of 1% o-dianisidine in 12 ml of 0.1 M potassium phosphate buffer pH 6.0. Saturate with oxygen for 10 minutes within 30 minutes of use.

Enzyme: Dissolve at one mg/ml in reagent grade water. Dilute further to 0.02-0.06 ΔA/min. in reagent grade water for assay.

Procedure: Set spectrophotometer at 460 nm and 25° C. Pipette into cuvette as follows:

| Reagent | Quantity |
|---|---|
| Dianisidine-buffer mixture, pH 6.0 (oxygenated) | 2.5 ml |
| 18% Glucose | 0.3 ml |
| Peroxidase | 0.1 ml |

Incubate in spectrophotometer for 3-5 minutes to achieve temperature equilibration and establish blank rate if any. Add 0.1 ml of appropriately diluted enzyme and record increase in $A_{460}$ for 4-5 minutes. Calculate $\Delta A_{460}$ from the initial linear portion of the curve.

Calculation:

$$\text{Units/mg} = \frac{\Delta A460/\text{min}}{11.3 \times \text{mg enzyme/ml reaction mixture}}$$

3) Assay of Cellulase

Method: Cellulase activity is determined by its effect on microcrystalline cellulose with respect to glucose formation. Released glucose is determined in a hexokinase/glucose-6-phosphate dehydrogenase system at 340 nm. One unit of activity releases 0.01 mg glucose per hour from micro-crystalline cellulose at 37° C. and pH 5.0 under the specified conditions.

| Reagents | 0.05 M Acetic acid, pH 5.0, Microcrystalline cellulose (Avicel, F.M.C. or equivalent)), Glucose determination reagent* |
|---|---|
| ATP | 0.77 μmol/ml |
| Hexokinase | 1.5 units/ml |
| NAD | 0.91 μmol/ml |
| Glucose-6-phosphate dehydrogenase | ≧1.9 units/ml |
| Tris•HCl buffer pH 7.6 ± 0.2 | 0.1 M |

*Can be replaced with a glucose assay utilizing a standard curve.

Enzyme: Dissolve enzyme in reagent grade water at a concentration of 1-0.1 mg/ml.

Procedure: Measure into clean dry test tubes as follows:

| Reagents | Test | Blank |
|---|---|---|
| Microcrystalline cellulose | 200 mg | 200 mg |
| 0.05M Acetic acid | 4.0 ml | 4.0 ml |
| Reagent grade water | — | 1.0 ml |
| Enzyme dilution | 1.0 ml | — |

Incubate with stirring or shaking for 2 hours at 37° C. Remove tubes to an ice bath and allow sediment to settle. Clarify by centrifugation. Store in an ice bath.

Place 3.0 ml glucose reagent in a cuvette and incubate in spectrophotometer set at 340 nm and 25° C. to achieve temperature equilibration. Record the $A_{340}$ of the glucose reagent in the cuvette. Add 0.1 ml of the supernatant from each reaction tube and record increase in $A_{340}$ until no further change occurs in 3-5 minutes. Record final $A_{340}$.

Calculation:

$$\Delta A340 = A340\text{Final} - A340\text{Initial}$$

$$\text{Units/mg} = \frac{(\Delta A340\text{Sample} - \Delta A340\text{Blank}) \times 3.1 \times 180 \times 5}{6.22 \times 10^3 \times 0.1 \times 2 \times 0.01 \times \text{mg enzyme in mixture}}$$

It will be evident to those skilled in the art that the invention is not limited to the details of the foregoing illustrative examples and that the present invention may be embodied in other specific forms without departing from the essential attributes thereof, and it is therefore desired that the present embodiments and examples be considered in all respects as illustrative and not restrictive, reference being made to the appended claims, rather than to the foregoing description, and all changes which come within the meaning and range of equivalency of the claims are therefore intended to be embraced therein.

We claim:

1. A process for biobleaching coupled with stone washing of indigo dyed denims comprising the steps of:

stonewashing the denim with cellulase; and, bleaching the denim with an enzyme blend comprising glucose oxidase, catalase and cellulase in the ratio of 1.0:10.0:1.0 along with dextrose monohydrate and peroxide source, under neutral pH of 6.5-7.0 and varying the processing time from 15 minutes to 90 minutes to obtain the desired worn look of the denim.

2. The process as claimed in claim 1, wherein the process is carried out at a temperature of 55 C.°.

3. The process as claimed in claim 1, wherein enzyme blend is instant in the amount of 1.5 gm of the enzyme blend per liter of the water and the garment: water ratio is 1:20.

4. The process as claimed in claim 1, wherein the enzyme blend needs no mediator and acidic pH adjustment.

5. The process claimed in claim 2, wherein the enzyme blend needs no mediator and acidic pH adjustment.

6. The process as claimed in claim 3, wherein the enzyme blend needs no mediator and acidic pH adjustment.

* * * * *